US009272193B1

(12) United States Patent
Yim

(10) Patent No.: US 9,272,193 B1
(45) Date of Patent: Mar. 1, 2016

(54) GOLF PUTTER

(71) Applicant: Hyung Jin Yim, Seoul (KR)

(72) Inventor: Hyung Jin Yim, Seoul (KR)

(73) Assignee: RHIMKOREA, CO., LTD., Pungmu-Ro, Gimpo-Si, Gyeonggi-Do (KR)

( * ) Notice: Subject to any disclaimer, the term of this patent is extended or adjusted under 35 U.S.C. 154(b) by 19 days.

(21) Appl. No.: 14/471,943

(22) Filed: Aug. 28, 2014

(51) Int. Cl.
*A63B 53/02* (2015.01)
*A63B 53/00* (2015.01)
*A63B 53/06* (2015.01)
*A63B 53/04* (2015.01)

(52) U.S. Cl.
CPC ..... *A63B 53/02* (2013.01); *A63B 53/007* (2013.01); *A63B 53/0487* (2013.01); *A63B 53/065* (2013.01); *A63B 2053/025* (2013.01)

(58) Field of Classification Search
CPC ..... A63B 53/02; A63B 53/007; A63B 2053/025; A63B 53/065; A63B 53/0487
See application file for complete search history.

(56) References Cited

U.S. PATENT DOCUMENTS 3,096,982 A * 7/1963 Bassin ..... A63B 53/06 473/248
3,214,170 A * 10/1965 Warnock ..... A63B 53/007 273/126 A
5,244,205 A * 9/1993 Melanson ..... A63B 53/065 473/248
5,462,279 A * 10/1995 Culpepper ..... A63B 53/065 473/248
5,863,257 A * 1/1999 Busnardo ..... A63B 53/02 473/246
6,142,884 A * 11/2000 Yim ..... A63B 53/02 473/248
7,367,896 B2 * 5/2008 Jackson ..... A63B 53/007 473/246
7,410,423 B2 * 8/2008 Pinder ..... A63B 53/02 473/244
8,870,674 B1 * 10/2014 Abbott ..... A63B 53/06 473/238
2003/0060301 A1 * 3/2003 Hsu ..... A63B 53/02 473/248
2006/0135279 A1 * 6/2006 Sandino ..... A63B 53/007 473/248
2006/0264264 A1 * 11/2006 Sandino ..... A63B 53/007 473/248
2014/0378243 A1 * 12/2014 Sanyal ..... A63B 53/065 473/313
2015/0080143 A1 * 3/2015 Sanyal ..... A63B 53/06 473/248
2015/0151169 A1 * 6/2015 Davis ..... A63B 53/007 473/313

FOREIGN PATENT DOCUMENTS

WO WO 9930784 A1 * 6/1999 ..... A63B 53/02

* cited by examiner

*Primary Examiner* — Stephen Blau
(74) *Attorney, Agent, or Firm* — John K. Park; Park Law Firm

(57) ABSTRACT

The golf putter is configured such that the stop step of the rotary linkage is formed outwardly in an extended length to cause the lock screws to stop the rotary linkage from being rotated with a large torque at a position remote from the center of the threaded axle hole, so that when a user does not desire to change the lie angle in use, the adjusted lie angle is not changed for a long period of time.

4 Claims, 3 Drawing Sheets

GOLF PUTTER

CROSS-REFERENCE TO RELATED APPLICATIONS

This application claims the benefit of Korean Patent Application No. 10-2013-0104616, filed on Sep. 2, 2013 in the Korean Intellectual Property Office, which is incorporated herein by reference in its entirety.

BACKGROUND OF THE INVENTION

1. Field of the Invention

The present invention relates to a golf putter used for putting, which can adjust the angle (i.e., the lie angle) formed between a putter head and a shaft.

2. Description of Related Art

There are an estimated 60 million golfers worldwide today, and golf is considered a very popular sport, particularly in developed countries. Golf is a very simple exercise in which a golfer uses fourteen golf clubs to put a golf ball into eighteen holes/cups on the green, which are approximately 10-546 yards far away from each other, through the process of hitting tee shots and approach shots. However, it is known that most golfers feel stress but not amusement when putting on the green as a finishing step in each hole. The reason for this is that the diameter of the hole is no more than 10 cm and it is difficult to set the aiming point and adjust the distance between the golf ball and the hole according to the slop of the putting green. But first of all, the reason why the golfers feel stress with putting is that since a golf putter a golfer uses does not fit the somatotype characteristics of the golfer, the direction in which a putted golf ball rolls initially toward the hole does not align with a desired direction. For example, accuracy in the directionality of a golf ball is required to be more than 99% in order to put a golf ball 5 m away from a hole into the hole even on a relatively flat putting green having no a slope. The problem associated with the putting resides in that in the case where a collision occurs between a putter head and a golf ball putted with a perfect stroke through more practice, if the putter head is not maintained in a horizontal state, the front striking surface of the golf putter is not oriented toward an aiming point set by a player, and as a result the golf ball does not roll correctly in the direction the aiming point. For example, when a player hits a putting shot three meters on the putting green having no a slope, if the putter head is aimed at the hole in a state in which a toe is lifted by 7 degrees, the slotline of the golf putter is oriented toward the hole but the front surface of the putter head confronts the left edge of the hole so that although the golf ball is rolled in a straight line, it passes by the hole. But actually, since the front surface of the golf putter is not perpendicular to the progress direction (i.e., the center of the hole) of the putter head, the golf ball upon the collision against the putter head is spinning to the side in a counterclockwise direction, and the rolling golf ball is greatly deviated from the hole in a hook shape in which the golf ball is spinning to the left as if the rolling golf ball rolled on a left downhill slope. This phenomenon very frequently occurs in most weekend golfers and many professional golfers. However, most golfers consider a cause of the phenomenon to be a problem associated with their stroke or a failure to correctly grasp the slope of the green. Of course, the lie angle of the golf putter that does not fit the somatotype characteristics of the golfer is one of various key factors that hinder the dropping of a golf ball into the hole, but also is a problem that can be solved in the easiest manner.

Nowadays, many kinds of golf putters are manufactured by numerous golf club manufacturers, but the somatotype characteristics and the putting postures of the golfers vary depending on the golfers and thus it is not easy to purchase golf putters correctly that fit their somatotype characteristics and putting postures. Furthermore, since the somatotype characteristics and the putting postures of the golfers vary over time, it is difficult to find new golf putters that fit them each time. Thus, the above-mentioned problems will be solved by a golf putter in which the angle (i.e., the lie angle) formed between a putter head and a shaft can be adjusted, if necessary. In particular, a lie angle adjustable golf putter requires that the lie angle should be adjusted only when a player desires to adjust it. In addition, the lie angle adjustable golf putter cannot be used in a formal golf game until it receives an approval from the United States Golf Association (USGA) or R&A.

Inventors have provided numerous golf putters that comply with the above purpose over the past several decades. However, most inventions related to golf putters entails a lot of problems in the actual use thereof, golfers suffer from an inconvenience in use, or the approval of the golf putters is denied by USGA or R&A. For this reason, the golf putters provided by the inventors have nearly disappeared on the market before they reach real consumers. For example, U.S. Pat. No. 5,580,051 discloses an adjustable golf club putter which comprises a putter head and a shaft interconnected by means of an adjustable gear linkage comprising a shaft gear and a hosel gear, each of which has a gear teeth, and the shaft gear and the hosel gear are engaged with or disengaged from each other by means of tightening or loosing of a bolt so as to adjust the lie angle formed between the putter head and the shaft. However, such a conventional adjustable golf club putter entails a shortcoming in that the gear linkage is large and complicated in terms of structure, and that since the adjustable lie angle has a limited range, it is not easy for a golfer to obtain a desired lie angle. U.S. Pat. No. 5,542,665 discloses an adjustable golf putter in which an angle adjustment means is connected to an adaptor interconnecting a putter head and a shaft, the adaptor being connected to a rear surface of the putter head. Since the adaptor is disposed on the rear surface, the distance between an adaptor portion connected to the shaft and a ball striking portion are longer than that in general golf putters, thus causing a problem in that a golfer must hit a putting shot pullingly but not pullingly. In addition, U.S. Pat. No. 4,815,740 discloses an adjustable golf club in which the line of the center of gravity of the golf club putter is used as an ideal axis, a circular array of V-shaped serrations is arranged on the axis, and another set of similar serrations are connected to a shaft by a hosel linkage. This configuration is theoretically excellent, but encounters a problem in that the golf club is complicated structurally due to an unnecessary part such as a compression spring, resulting in a deficiency of simplicity and practicality needed for mass production.

Accordingly, the present inventor has proposed an adjustable golf putter disclosed in U.S. Pat. No. 6,142,884 corresponding to Korean Patent Registration No. 10-0584815 in an attempt to solve the problems occurring in the existing prior arts, and receives popularity from golfers with the success in mass production of the golf putter. However, such a golf putter has a problem in that if it is used for a long period of time after adjusting and fixing the lie angle, lock screws are often loosened from the threaded holes. A lie angle adjustable golf putter requires that the adjusted lie angle of the golf putter should not be changed and a locking means for securely fixing a shaft and a putter head should not swivel the putter head in use. Particularly, in the case where the lock screws of the locking means are loosened means during the golf game to cause the putter head to be swiveled, unless a tool for tightening the lock screws is prepared, a golfer suffers from a great inconvenience.

SUMMARY OF THE INVENTION

Accordingly, the present invention has been made in order to solve the above-described problems occurring in the prior art, and it is an object of the present invention to provide an improved golf putter in which when a user does not desire to change the lie angle in use, the adjusted lie angle is not changed for a long period of time.

The locking means needs to be improved in order to prevent the adjusted lie angle of the golf putter from being changed.

The locking means of the golf putter disclosed in U.S. Pat. No. 6,142,884, which is an earlier invention of the present inventor, comprises an axle bolt for securely coupling an adjustment means serving as a rotary linkage to the putter head, a stop step formed at a lower portion of the rotary linkage, and a rotation locking means including lock screws coupled to the lower portion of the putter head so as to bear the stop step to prevent the rotation of the rotary linkage. However, the earlier invention of the present inventor has a problem in that since the transverse length of the stop step of the rotary linkage is short, a relatively large force is needed to suppress the rotation of the rotary linkage, and in that since the length of the lock screws is also short, the lock screws are unintentionally loosened due to the large rotation-suppressing force of the rotary linkage. Accordingly the present inventor has improved the rotation locking means to provide a golf putter in which when a user does not desire to change the lie angle in use, the adjusted lie angle is not changed.

To accomplish the above object, in accordance with the present invention, there is provided a golf putter configured such that a rotary linkage has a semi-cylindrical body as a projecting round axle-receiving portion, formed at the center of a lower portion thereof and a stop step formed at both sides of the semi-cylindrical body, the stop step is formed between a lower portion and an upper end of a threaded axle hole, preferably, at a position between the center and the upper end A of the threaded axle hole, and an accommodating space part of a putter head has a concaved accommodating groove formed on a bottom surface thereof so as to allow the semi-cylindrical body of the rotary linkage to be accommodated therein, and a protrusion protruded upwardly at both sides the accommodating groove so as to allow threaded holes to be formed in an extended length. Thus, the stop step of the rotary linkage is formed outwardly in an extended length to cause the lock screws to stop the rotary linkage from being rotated with a large torque at a position remote from the center of the threaded axle hole, and the stop is positioned at a higher position from the bottom surface of the putter head to cause the threaded holes formed at the lower portion of the accommodating space part to be formed in an extended length L2.

BRIEF DESCRIPTION OF THE DRAWINGS

The above and other objects, features and advantages of the present invention will be apparent from the following detailed description of the preferred embodiments of the invention in conjunction with the accompanying drawings, in which.

EXPLANATION ON SYMBOLS

Figure 1:
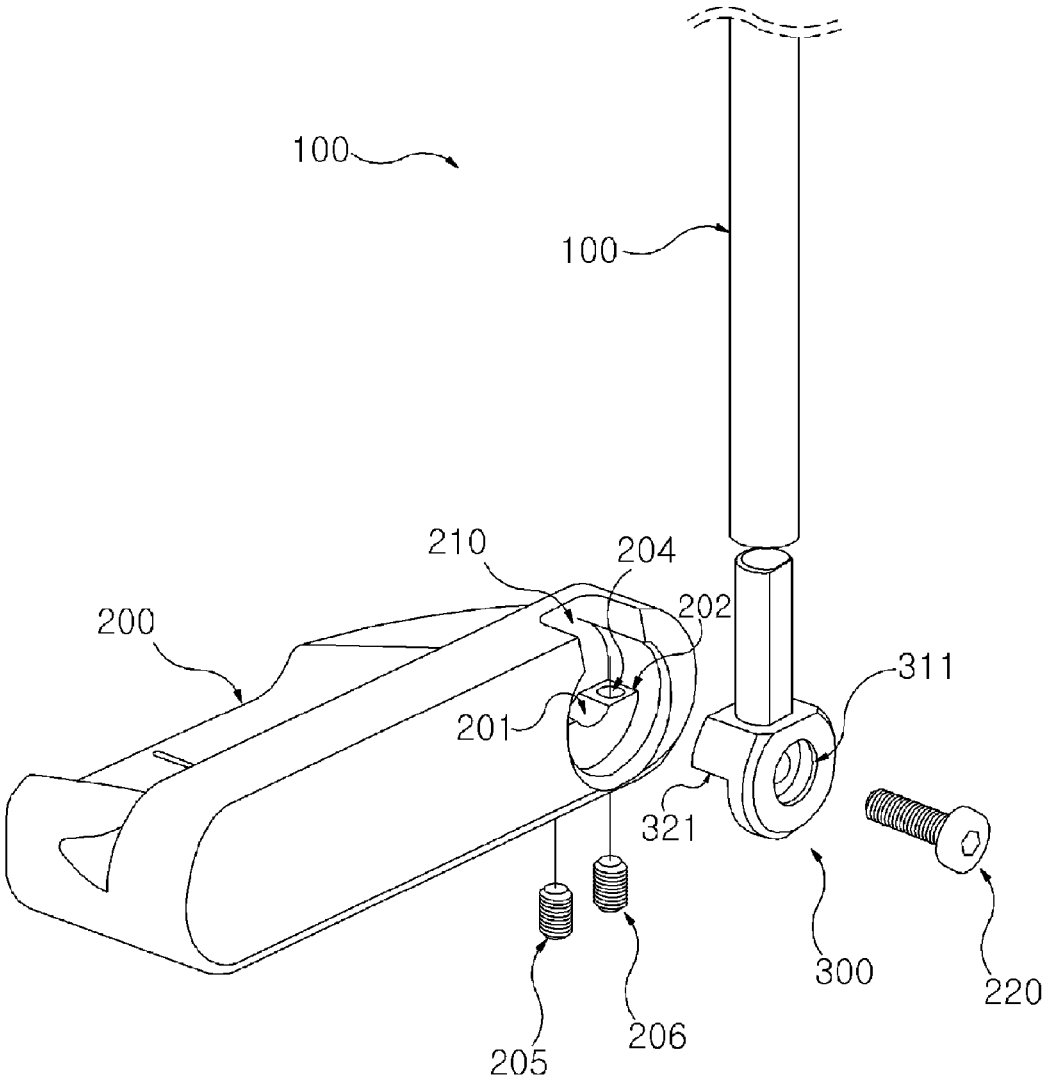
FIG. 1 is a perspective view showing a golf putter according to an embodiment of the present invention.

100: shaft
200: putter head
210: accommodating space part
201: accommodating groove
202: protrusion
203, 204: threaded hole
205, 206: lock screw
207: anti-loosing screw
220: axle bolt
300: rotary linkage
311: threaded axle hole
321: stop step
322: semi-cylindrical body

DESCRIPTION OF SPECIFIC EMBODIMENTS

Now, preferred embodiments of the present invention will be described in detail with reference to the accompanying drawings.

A golf putter according to the present invention comprises a shaft 100; a rotary linkage 300 coupled to a lower end of the shaft 100; and a putter head 200 having an accommodating space part 210 formed at one side thereof to allow the rotary linkage 300 to be accommodated therein. The rotary linkage 300 has a threaded axle hole 311 formed therein so that the rotary linkage 300 is securely fixed to the accommodating space part 210 by an axle bolt 220 tightened into the threaded axle hole 311. The axle bolt 220 is released from the tightened state to cause the rotary linkage 300 to be rotated so as to adjust a lie angle formed between the shaft and the putter head 200 and then is again tightened into the threaded axle hole 311 to cause the rotary linkage 300 to be securely fixed to the accommodating space part 210. The rotary linkage 300 has a stop step 321 formed at a lower portion thereof, and the accommodating space part 210 has a pair of opposed threaded holes 203 and 204 formed at a lower portion thereof so as to be oriented toward the stop step 321 of the rotary linkage 300, and a pair of lock screws 205 and 206 screw-coupled to the threaded holes 203 and 204 so that an abutment surface of the stop step 321 of the rotary linkage 300 by which the lie angle is adjusted is abutted against the lock screws 205 and 206 to prevent the rotary linkage 300 from being rotated.

The golf putter of the present invention is configured such that the rotary linkage 300 has a semi-cylindrical body 322 as a projecting round axle-receiving portion, formed at the center of a lower portion thereof and a stop step 321 formed at both sides of the semi-cylindrical body 322, the stop step 321 is formed between a lower portion and an upper end of the threaded axle hole 311, preferably, at a position between the center and the upper end A of the threaded axle hole 311, and the accommodating space part 210 of the putter head 200 has a concaved accommodating groove 201 formed on a bottom surface thereof so as to allow the semi-cylindrical body 322 of the rotary linkage 300 to be accommodated therein, and a protrusion 202 protruded upwardly at both sides the accommodating groove 201 so as to allow the threaded holes 203 and 204 to be formed in an extended length. Thus, the stop step 321 of the rotary linkage 300 is formed outwardly in an extended length to cause the lock screws 205 and 206 to stop the rotary linkage 300 from being rotated with a large torque at a position remote from the center of the threaded axle hole 311, and the stop 321 is positioned at a higher position from the bottom surface of the putter head to cause the threaded holes 203 and 204 formed at the lower portion of the accommodating space part 210 to be formed in an extended length.

Figure 2:
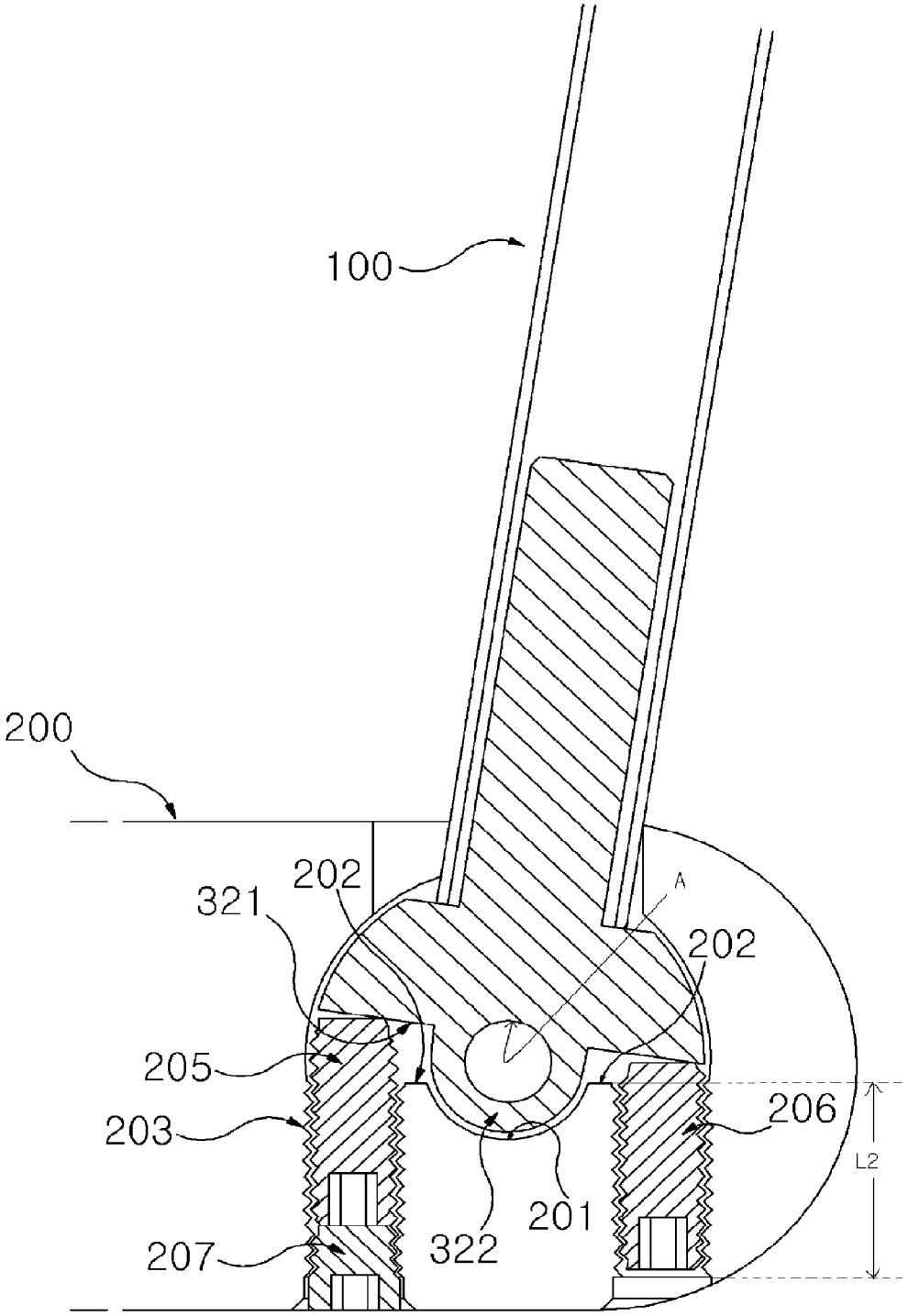
FIGS. 2 and 3 are cross-sectional views showing the main elements of the golf putter shown in FIG. 1 in a state in which a lie angle is adjusted and then a putter head and a shaft are securely fixed.
Figure 3:
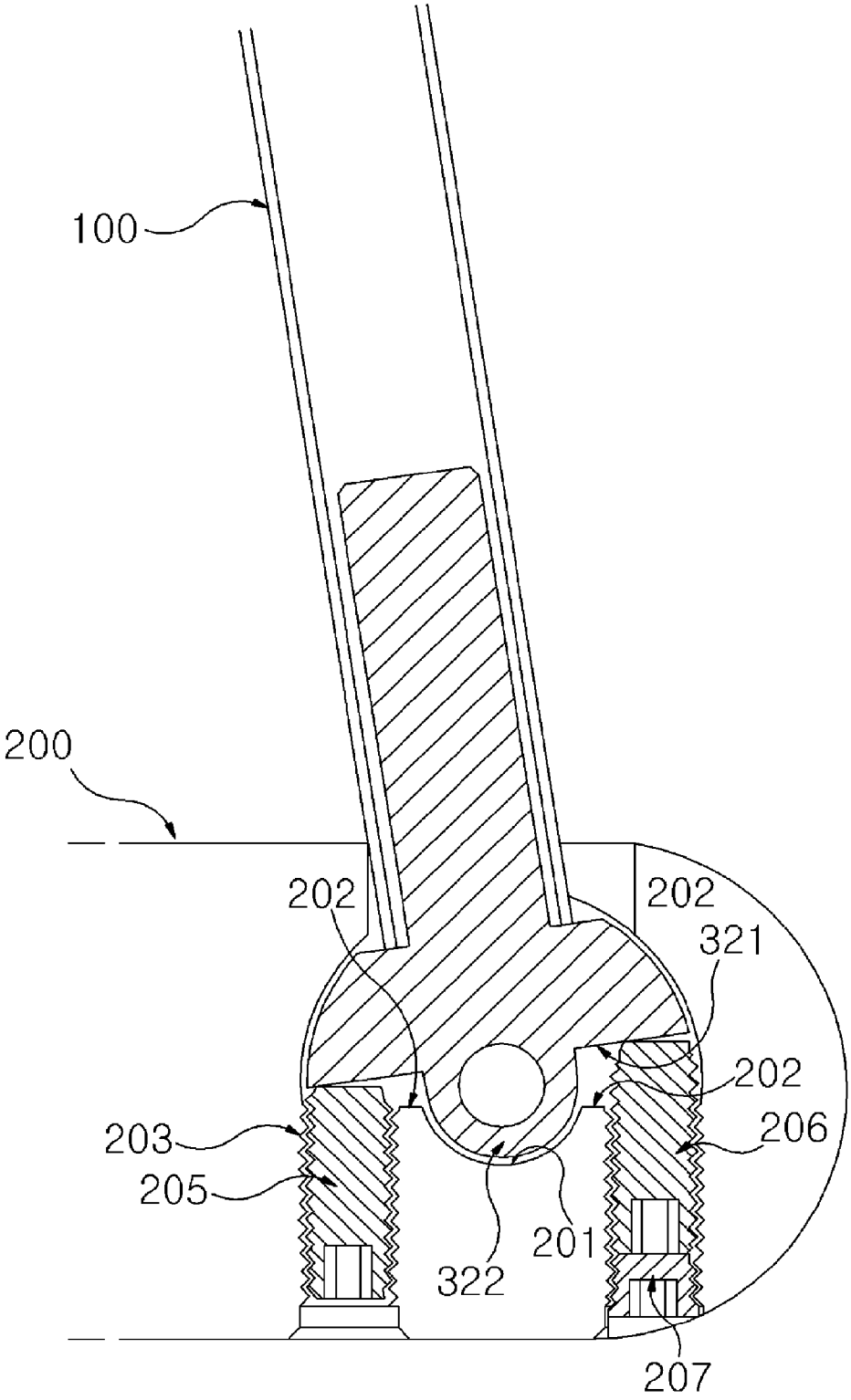

Furthermore, as shown in FIGS. 2 and 3, any one of the lock screws 205 and 206 is protruded upwardly and an anti-loosing screw 207 is screw-coupled to a lower portion of any one of threaded holes 203 and 204, so that the lock screws is prevented from being loosened unintentionally. As such, the reason why the anti-loosing screw 207 is mounted is that the threaded holes 203 and 204 are formed in an extended length.

As described above, the golf putter according to the present invention has the following advantageous effects.

The stop step of the rotary linkage is formed outwardly and transversely in an extended length to cause the lock screws bearing the stop step to stop the rotary linkage from being rotated with a large torque at a position remote from the center of the threaded axle hole 311, i.e., a rotational axis of the rotary linkage. In addition, the stop is positioned at a higher position from the bottom surface of the putter head to cause the threaded holes to be formed in an extended length so that the long lock screws are screw-coupled to the long threaded holes, thereby increasing the contact area between the lock screws and the threaded holes, and thus suppressing the unintentional loosing of the lock screws. Furthermore, the threaded holes are formed in an extended length so that the anti-loosing screw is screw-coupled to the lower portion of the upwardly protruded lock screw, thereby preventing at least one of the lock screws from being loosened, and thus preventing the lie angle of the golf putter from being changed in use.

While the present invention has been described in connection with the exemplary embodiments illustrated in the drawings, they are merely illustrative embodiments, and the invention is not limited to these embodiments. It is to be understood that various equivalent modifications and variations of the embodiments can be made by a person having an ordinary skill in the art without departing from the spirit and scope of the present invention. Therefore, various embodiments of the present invention are merely for reference in defining the scope of the invention, and the true technical scope of the present invention should be defined by the technical spirit of the appended claims.

What is claimed is:

1. A golf putter comprising:

a shaft 100;

a rotary linkage 300 coupled to a lower end of the shaft 100; and a putter head 200 having an accommodating space part 210 formed at one side thereof to allow the rotary linkage 300 to be accommodated therein, wherein the rotary linkage 300 has a threaded axle hole 311 formed therein so that the rotary linkage 300 is securely fixed to the accommodating space part 210 by an axle bolt 220 tightened into the threaded axle hole 311, wherein the axle bolt 220 is released from the tightened state to cause the rotary linkage 300 to be rotated so as to adjust a lie angle formed between the shaft and the putter head 200 and then is again tightened into the threaded axle hole 311 to cause the rotary linkage 300 to be securely fixed to the accommodating space part 210, wherein the rotary linkage 300 has a semi-cylindrical body 322 as a projecting round axle-receiving portion, formed at the center of a lower portion thereof and a stop step 321 formed at both sides of the semi-cylindrical body 322, wherein the accommodating space part 210 has a pair of opposed threaded holes 203 and 204 formed at a lower portion thereof so as to be oriented toward the stop step 321 of the rotary linkage 300, and a pair of lock screws 205 and 206 screw-coupled to the threaded holes 203 and 204 so that an abutment surface of the stop step 321 of the rotary linkage 300 by which the lie angle is adjusted is abutted against the lock screws 205 and 206 to prevent the rotary linkage 300 from being rotated, wherein the stop step 321 is formed between a lower portion and an upper end of the threaded axle hole 311, and wherein the accommodating space part 210 of the putter head 200 has a concaved accommodating groove 201 formed on a bottom surface thereof so as to allow the semi-cylindrical body 322 of the rotary linkage 300 to be accommodated therein, and a protrusion 202 protruded upwardly at both sides of the accommodating groove 201 so as to allow the threaded holes 203 and 204 to be formed in an extended length.

2. The putter according to claim 1, wherein the stop step 321 is formed at a position between the center and the upper end of the threaded axle hole 311.

3. The putter according to claim 2, wherein any one of the lock screws 205 and 206 is protruded upwardly and an anti-loosing screw 207 is screw-coupled to a lower portion of any one of threaded holes 203 and 204, thereby preventing the lock screws from being loosened unintentionally.

4. The putter according to claim 1, wherein any one of the lock screws 205 and 206 is protruded upwardly and an anti-loosing screw 207 is screw-coupled to a lower portion of any one of threaded holes 203 and 204, thereby preventing the lock screws from being loosened unintentionally.

* * * * *